US007802795B2

(12) United States Patent
Bos

(10) Patent No.: US 7,802,795 B2
(45) Date of Patent: Sep. 28, 2010

(54) PORTABLE HORSESHOE/RING TOSS GAME

(76) Inventor: Daniel M. Bos, 5N547 Central Rd., Itasca, IL (US) 60143

( * ) Notice: Subject to any disclaimer, the term of this patent is extended or adjusted under 35 U.S.C. 154(b) by 72 days.

(21) Appl. No.: 12/354,772

(22) Filed: Jan. 16, 2009

(65) Prior Publication Data

US 2010/0181726 A1 Jul. 22, 2010

(51) Int. Cl.
*A63F 7/30* (2006.01)

(52) U.S. Cl. ..... 273/336; 273/348

(58) Field of Classification Search ..... 273/317, 273/336–339, 342, 348
See application file for complete search history.

(56) References Cited

U.S. PATENT DOCUMENTS 1,178,049 A * 4/1916 Beardsley ..... 273/336
1,541,897 A * 6/1925 Buedingen ..... 273/336
2,146,457 A * 2/1939 Vernon ..... 473/588
2,230,294 A * 2/1941 Heggie ..... 273/336
3,356,368 A * 12/1967 Dixon ..... 273/336
3,547,442 A * 12/1970 Fenicchia ..... 273/336
3,844,560 A * 10/1974 Litsch ..... 273/336
4,273,340 A * 6/1981 Hackett ..... 273/336
4,314,702 A * 2/1982 Updike et al. ..... 273/336
D266,678 S * 10/1982 Herrmann ..... D21/304
4,386,779 A * 6/1983 Whitlock ..... 273/336
4,952,073 A * 8/1990 Wieland ..... 383/4
4,964,644 A * 10/1990 Hull et al. ..... 273/336

* cited by examiner

*Primary Examiner*—Raleigh W. Chiu
(74) *Attorney, Agent, or Firm*—Justin Lampel

(57) ABSTRACT

A portable horseshoe game suitable for use in connection with an existing bags game. The game includes a rod which may be secured within the opening of the bags game. More specifically, the rod may be secured in a generally perpendicular position with respect to the target surface of the bags game. In an alternative embodiment, the rod may be secured in a generally perpendicular position with respect to the ground. The game has a first plate and a second plate secured to the rod wherein the first plate covers the top side of the opening of the target surface of the bags game and the second plate covers the bottom side of the opening of the target surface of the bags game. Once the rod is secured within the opening, users may play horseshoes on the existing bags target surface. The game may be played indoors or outdoors.

3 Claims, 3 Drawing Sheets

PORTABLE HORSESHOE/RING TOSS GAME

BACKGROUND OF THE INVENTION

A portable horseshoe game suitable for use in connection with an existing bags game. Although the application references the game of horseshoes, it should be noted that numerous games may be played with the following invention, including, but not limited to, the game of ring toss. The game includes a rod which may be secured within the opening of the bags game. More specifically, the rod may be secured in a generally perpendicular position with respect to the target surface of the bags game. In an alternative embodiment, the rod may be secured in a generally perpendicular position with respect to the ground. The game has a first plate and a second plate secured to the rod wherein the first plate covers the top side of the opening of the target surface of the bags game and the second plate covers the bottom side of the opening of the target surface of the bags game. Once the rod is secured within the opening, users may play horseshoes on the existing bags target surface. The game may be played indoors or outdoors.

The game of bags is an extremely popular game today for many reasons including, but not limited to, its easy of playing, its inexpensiveness and its portability. The game is generally played by players of all ages at BBQs, tailgating parties, picnics or on otherwise uneventful lazy summer afternoons. In the game, a player attempts to toss a small bag (usually containing beads, sand or corn) into an opening located on the opposing player's slanted target surface placed. The opposing target surfaces are generally placed approximately ten yards away (although the distance may vary a good deal depending on the age and skill of the players). In the past, previous games have been invented which attempt to incorporate features of bags and horseshoes. For example, U.S. Pat. No. 5,067,727 to Crompton discloses a game of skill playable both indoors and outdoors includes two flat circular target boards, the upper surface of which are covered with a deep pile fabric. The game also includes toroidal-shaped throwing rings having a flexible cover and filled loosely with a quantity of small weights such as pebbles. Strips of fabric hook material having an abundance of tiny protruding hooks adapted to engage the pile of the target board covering material are attached to the upper and lower annular surfaces of each throwing ring. When a ring is cast upon a distant target board, the hooks protruding from the ring become entangled with strands of the fabric covering of the target board, adhering the ring to the board. Movement of the weights within the throwing ring produces an oscillation-damping action which minimizes any tendency of the ring to bounce off the target board after impact.

U.S. Pat. No. 4,736,955 to Pollack discloses a pitch and toss game apparatus comprising a first target (10) and a plurality of throwing objects (17). The first target (10) is constructed with a centrally located cylindrical cavity (11). The upper surface (10u) of the first target (10) has a layer of a first contact engaging material (12) attached to it. The throwing objects (17) are covered with a second contact engaging material (18), complementary to the material covering the upper surface (10u) of the first target (10). When the throwing object (17) is pitched or tossed towards the first target (10), the first contact engaging material (12) of the first target (10) and the second contact engaging material (18) of the throwing object (17) cause the throwing object (17) to firmly stick to the first target (10) at or near the point of initial contact should the throwing object (17) miss landing in the centrally located cylindrical opening (11). A pole shaped member (20) may be later fitted inside the centrally located cylindrical cavity (11) to transform the primary pitch and toss game apparatus into a ring/horseshoe style pitch and toss game. A second target (28) having its top surface (29) covered with a first contact engaging material (12) and the lower surface of the second target (28) covered with a second contact engaging material (18) may later be affixed to the first target (10) to transform the primary pitch and toss game into a "tic-tac-toe" style pitch and toss game.

U.S. Pat. No. 4,726,591 to Johnson discloses a recreational game device which may be used indoor or outdoor for use with playing several skill games. Targets are located on the game device and are used for playing various games.

U.S. Pat. No. 3,815,915 to Chapman discloses a game in which solid discs and hollow rings are pitched or tossed by competitive players at the recessed holes and at the erect pins respectively of each of the two similar game boards. Each recessed hole and each erect pin is marked with a score value. The two similar game boards fit together for storage purposes, folding about the detachable hinge joint so that the erect pins of one board are located in the opposite recessed holes of the other board in the folded storage mode.

The problem with many existing horseshoe and horseshoe-type games is that they fail to provide a manner in which one may easily convert an existing bags game into a sturdy and durable horseshoe game. Instead, these existing games generally only incorporate bags and/or horseshoe-like features. Further, previous horseshoe or horseshoe-type games generally are not adaptable for use with existing bags game. A need, therefore, exists for an improved portable horseshoe game. A still further need exists for an improved horseshoe game which is adaptable for use in virtually all existing bags games.

SUMMARY OF THE INVENTION

A portable horseshoe game suitable for use in connection with an existing bags game. The game includes a rod which may be secured within the opening of the bags game. More specifically, the rod may be secured in a generally perpendicular position with respect to the target surface of the bags game. In an alternative embodiment, the rod may be secured in a generally perpendicular position with respect to the ground. The game has a first plate and a second plate secured to the rod wherein the first plate covers the top side of the opening of the target surface of the bags game and the second plate covers the bottom side of the opening of the target surface of the bags game. Once the rod is secured within the opening, users may play horseshoes on the existing bags target surface. The game may be played indoors or outdoors.

An advantage of the game is to provide a portable horseshoe game which may be easily secured to an existing bags game.

Yet another advantage of the game is to provide a portable horseshoe game which may be quickly secured to an existing bags game.

A still further advantage of the game is to provide a portable horseshoe game which is durable.

And an advantage of the game is to provide a portable horseshoe game which has two sticky plates used to secure a rod in an opening of a bags game.

Another advantage of the game is to provide a portable horseshoe game which prevents damage to a lawn.

Still another advantage of the game is to provide a portable horseshoe game which may allow a user to secure a rod upright even on a concrete or solid surface.

A still further advantage of the game is to provide a portable horseshoe game which eliminates the need to dig a hole and secure a rod into a lawn or other surface.

In an embodiment, the portable horseshoe game may have: a generally cylindrical rod having a first end, a second end, a width and a length; a first plate having a top side and a bottom side and an opening wherein the opening of the first plate is slightly larger than the width of the rod; a second plate having a top side and a bottom side and an opening wherein the opening of the second plate is slightly larger than the width of the rod; a securing device for securing the first plate to the rod and a securing device for securing the second plate to the rod wherein the rod is inserted through the first plate and the second late; and wherein the first plate and the second plate are separated by and secured on a target surface of a bags toss game.

In another embodiment of the portable horseshoe game the rod is bent at an angle substantially equal to an angle of the target surface of the bags toss game with respect to the ground.

In yet another embodiment the portable horseshoe game may have a gasket creating a seal between the first plate and the target surface of a bags toss game and a second gasket creating a second seal between the second late and the target surface of a bags toss game and wherein the first plate and the second plate are at least partly secured to the target surface of the bags toss game by suction forces.

In still another embodiment, the portable horseshoe game may have a tapered edge on the first plate wherein the tapered edge allows an object to slide easily from the target surface of a bags toss game onto the top of the first plate.

For a more complete understanding of the above listed features and advantages of the portable horseshoe game, reference should be made to the following detailed description of the preferred embodiments and to the accompanying drawings. Further, additional features and advantages of the present invention are described in, and will be apparent from, the detailed description of the preferred embodiments and from the drawings.

DETAILED DESCRIPTION OF THE PREFERRED EMBODIMENTS

Figure 1:
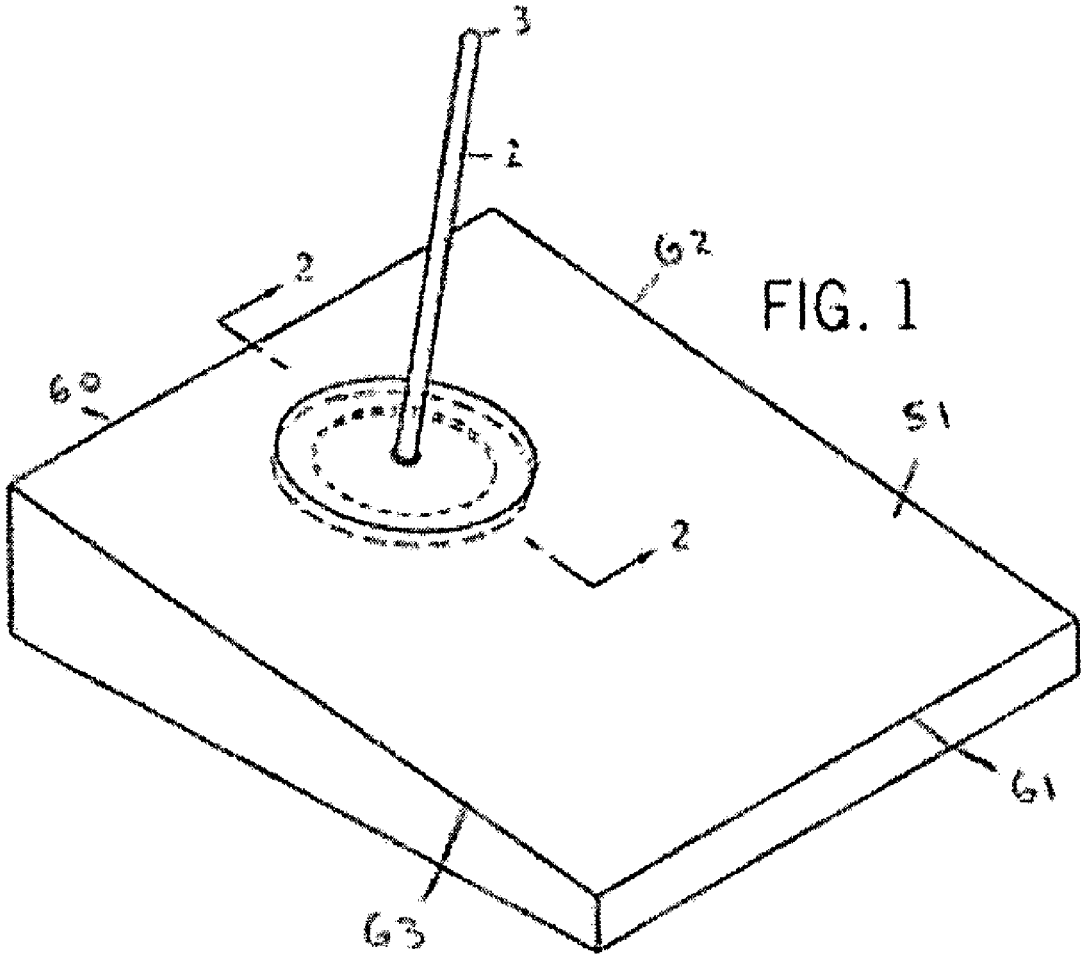
FIG. 1 illustrates a side perspective view of the portable horseshoe game assembled on a bags game.

A portable horseshoe game suitable for use in connection with an existing bags game. The game includes a rod which may be secured within the opening of the bags game. More specifically, the rod may be secured in a generally perpendicular position with respect to the target surface of the bags game. In an alternative embodiment, the rod may be secured in a generally perpendicular position with respect to the ground. The game has a first plate and a second plate secured to the rod wherein the first plate covers the top side of the opening of the target surface of the bags game and the second plate covers the bottom side of the opening of the target surface of the bags game. Once the rod is secured within the opening, users may play horseshoes on the existing bags target surface. The game may be played indoors or outdoors.

Referring now to the figures wherein like numerals referral to like parts, the portable horseshoe game 1 may have a rod 2 having a first end 3, a second end 4, a length 5 and a width 6. Preferably, the rod 2 is cylindrical, although the rod 2 may have a different shape. In addition, the rod 2 is preferably made from plastic, although a metal or other material may be used depending on the type of portable horseshoe game 1 being constructed.

The portable horseshoe game 1 may have a first plate 10 and a second plate 20. The first plate 10 and the second plate 20 may have an angled edge 100 which may allow an object (such as a horseshoe) to slide up and over the first plate 10 and second plate 20 from a target surface 51, as discussed below. The first plate 10 and the second plate 20 illustrated in the figures are circular; however, any suitable shape may be used to achieve its desired function. The first plate 10 may have a top side 11 and a bottom side 12. The second plate 20 may have a top side 21 and a bottom side 22. Preferably, the sizes of the first plate 10 and the second plate 20 are substantially similar so as to allow for easier packaging and/or transporting of the device. In embodiments with a circular first plate 10 and a circular second plate 20, the first plate 10 may have a diameter 13 and the second plate 20 may have a diameter 23. As stated above, preferably the diameter 13 of the first plate 10 is substantially similar to the diameter 23 of the second plate 20. In embodiments with a non-circular first plate 10 and a non-circular second plate 20, the first plate 10 and the second plate 20 may have a side having a length larger than a diameter 53 of an opening 52 located on a target surface 51 of a bags game 50 (as discussed below).

A generally circular opening 15 may be located at the center of the first plate 10. A generally circular opening 25 may be located at the center of the second plate 20. The opening 15 at the center of the first plate 10 may have a diameter 16 which may be slightly larger than the width 6 of the rod such that the rod 2 may be inserted through the opening 15 and may fit snugly within the opening 15 of the first plate 10. The opening 25 at the center of the second plate 20 may have a diameter 26 which may be slightly larger than the width 6 of the rod 2 such that the rod 2 may fit snugly through the opening 25 of the second plate 20.

As mentioned above, the portable horseshoe game 1 unit may be used to convert a bags game 50 into a game of horseshoes. A typical bags game 50 consist of two matching units and some bags 70 containing, for example, corn, sand, beads or the like. The two matching units each have a target surface 51 having a top end 60, a bottom end 61, a first side 62 and a second side 63. Further, the target surface 51 generally has an opening 52 often located around ¾ of the way toward the top end 60 of the target surface 51. The opening 52 generally has a diameter 53 comfortably larger than the size of the bags 70 such that the bags 70 may pass through the opening 52 with a little room on each side of the bag 70. The larger the opening 52, the easier the game is. Players take turns tossing the bags 70 in an attempt to successfully toss the bags 70 into the opening 52 on the target surface 51 located a short distance away (typically around 10 yards away). The top end 60 of the target surface 51 is generally angled upward with respect to the bottom end 61 of the target surface 51 such that when a bag 70 hits the target surface 51 it may be prevented from sliding substantially toward the top end 61 of the target surface 51 (if the bag does not go through the opening 52). Some sliding of the bags 70 is desired. Players generally keep score on the number of bags 70 successfully tossed into the opening 52 and/or the closest bag 70 located to the opening 52. The angle of the target surface 51 with respect to the ground may vary, but a typical target surface 51 may have an upward angle between twenty and forty degrees.

To convert the bags game 50 into a game of horseshoes, the user must cover the openings 52 on the target surface 51. The user first inserts the rod 2 through the opening 15 of the first plate 10 so that the first plate 10 fits snugly around the rod 2 in a predetermined located. More specifically, the first plate 10 may be pushed tip the rod 2 until it comes into contact with a washer 71 secured to the rod 2. The user may then insert the rod 2 through the opening 52 on the target surface 51 through the top side of the target surface 51. Accordingly, the first plate 10, having a larger diameter 13 than the opening 52 of the target surface 51, covers the opening 52 of the target surface 51. The top side 11 of the first plate 10 now faces upward and the bottom side 12 of the first plate 10 faces the ground. Further, the first plate 10 is now located between the washer 70 on the rod 2 and the target surface 51 of the bags game 50.

Next, the user sides the second plate 20 over the rod 2 (which is already in place within the opening 52 of the target surface 51. The user inverts the second plate 20 so that the top side 21 of the second plate 20 faces downward toward the ground and the bottom side 22 of the second plate 20 faces upward toward the sky. When inserted over the rod 2, the second plate 20 covers the opening 52 of the target surface 51 from the bottom side. A securing washer and/or nut 71 is then secured over the rod 2 so lock the rod 2, the first plate 10 and the second plate 20 in a secure position within the opening 52 of the target surface 51. In this position, the rod 2 is located in a substantially perpendicular position with respect to the target surface 51. Thus, because the target surface 51 is generally angled, the rod 2 does not rest in a perpendicular position with respect to the ground. In an embodiment, the rod 2 may be bent (FIG. 6) at an angle roughly equal to the angle of the target surface 51 such that the rod 2 may be secured in a substantially perpendicular position with respect to the ground, instead of the target surface 51. To accomplish this, a portion of the rod 2 located above the first plate 10 (while the device is secured onto the target surface 51 of the bags game) may bend toward the top end 60 of the target surface 51 at an angle substantially equal to the angle of incline of the target surface 51.

Figure 2:
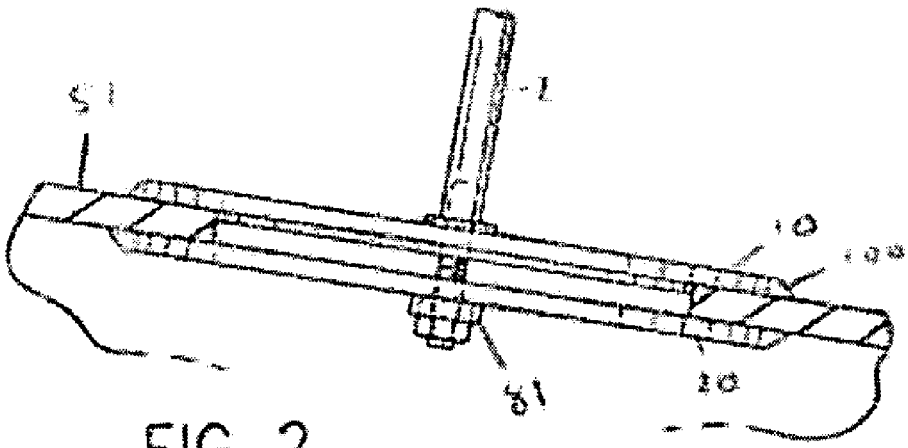
FIG. 2 illustrates a side plan view of the first and second plate secured around the target surface of a bags game.
Figure 3:
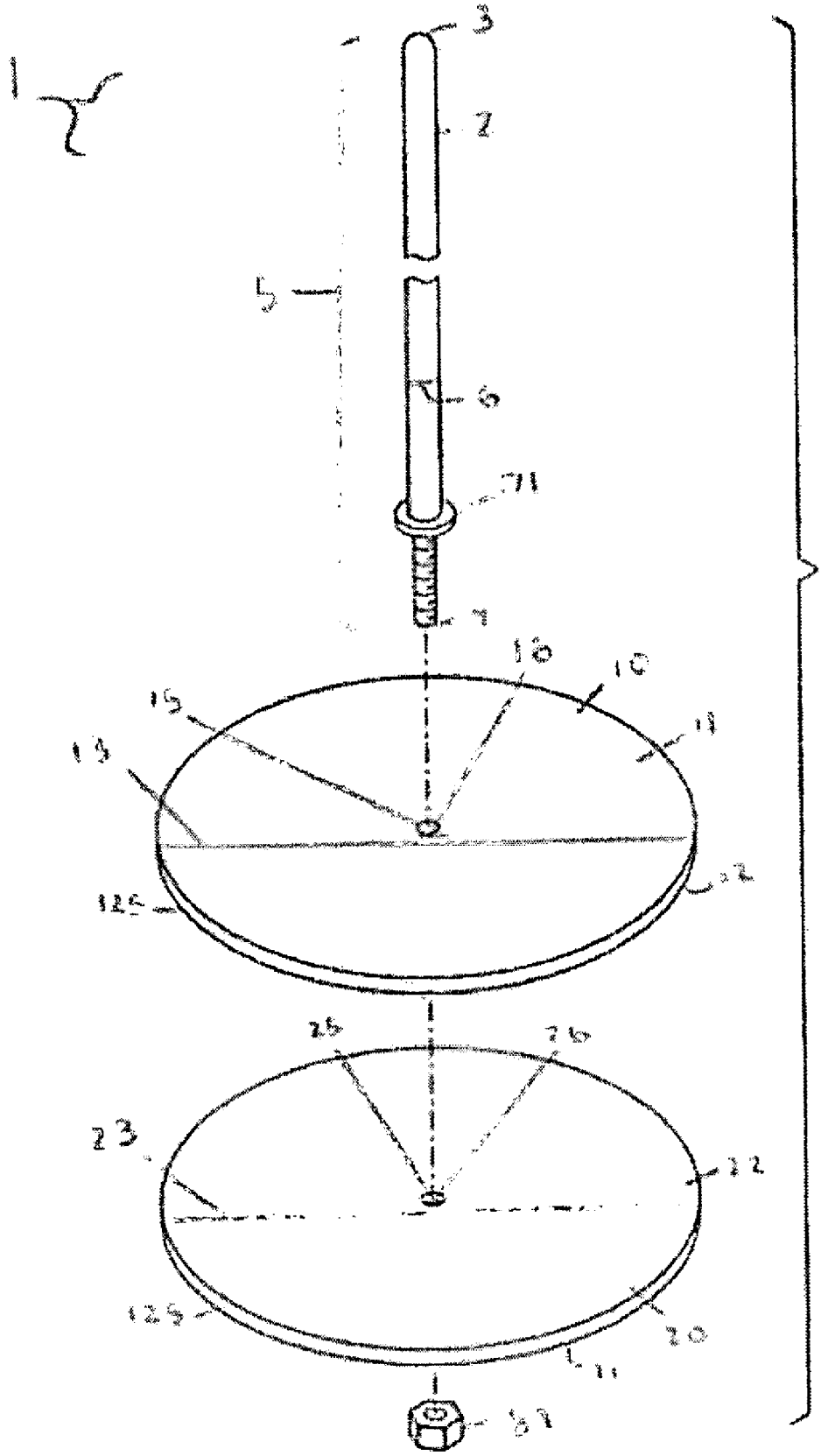
FIG. 3 illustrates an exploded side view of the portable horseshoe game.
Figure 4:
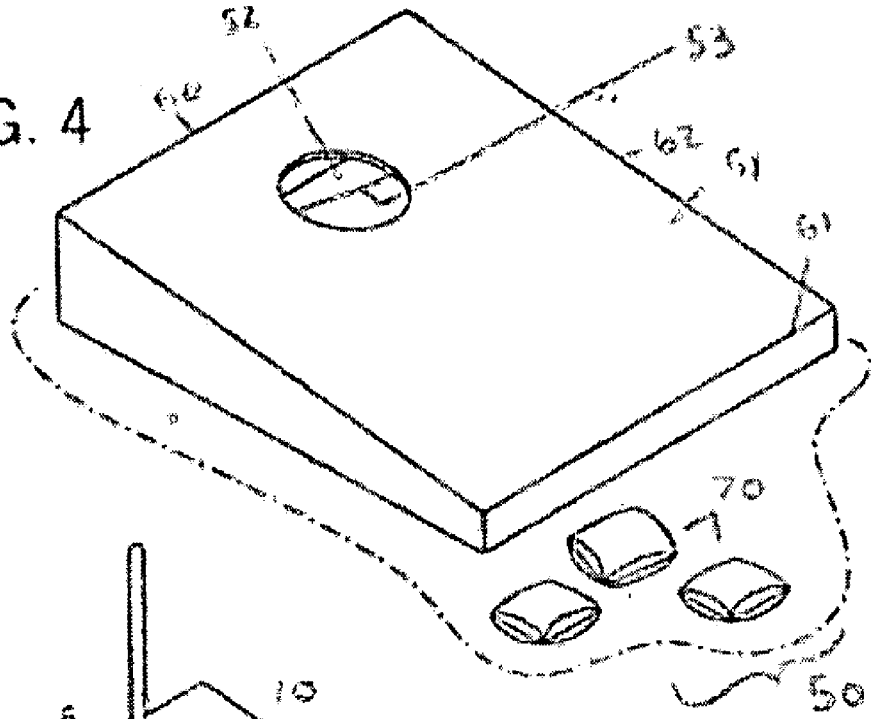
FIG. 4 illustrates a side perspective view of the target surface of a game of bags.
Figure 5:
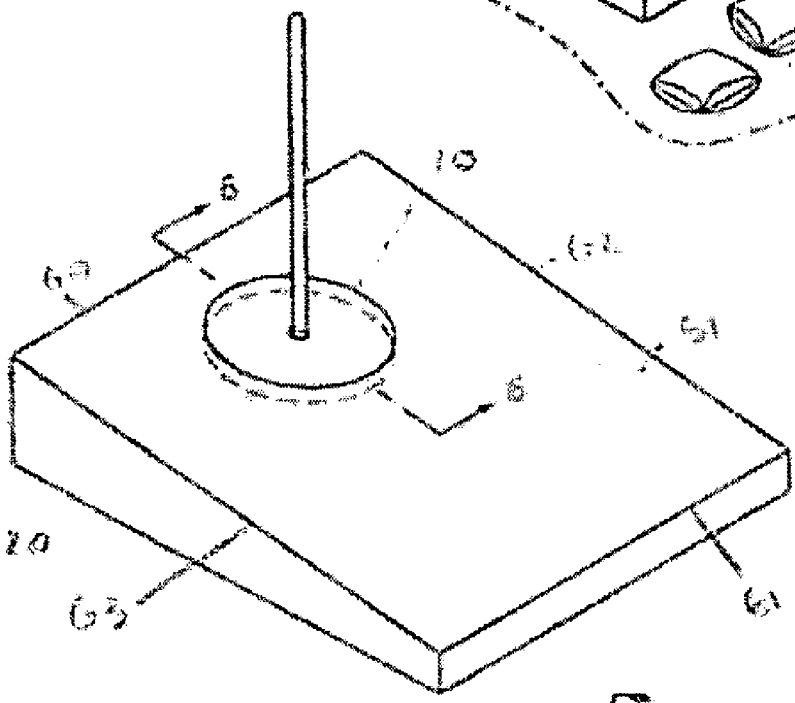
FIG. 5 illustrates a side perspective view of the target surface of a game of bags wherein the portable horseshoe game is inserted.

A securing mechanism 81, such as a nut, may secure the rod 2 to the second plate 2. The securing mechanism 81 (or nut) may be permanently secured to and part of the second plate 20 (FIG. 2) or the securing mechanism 81 (or nut) may be inserted over the rod 2 independently of the second plate 20 (FIG. 3).

Preferably, the rod 2 is secured so that the majority of the length 5 of the rod 2 is located above the surface of the target surface 51. Providing a large portion of the rod 2 above the surface of the target surface 51 increases the chances a user may get a "ringer" while tossing a horseshoe at the rod 2.

Securing the rod 2 onto an existing bags game 50 may help prevent damage a horseshoe may cause to a lawn by providing a landing surface (target surface 51) for the horseshoe. In addition, using the bags game 50 as a base may prevent the need to dig a hole in the ground for the rod 2, thereby saving time and damage to a lawn. Even further, using the bags game 50 may allow users to play horseshoes on a concrete surface without the need to drill into the concrete.

Figure 6:
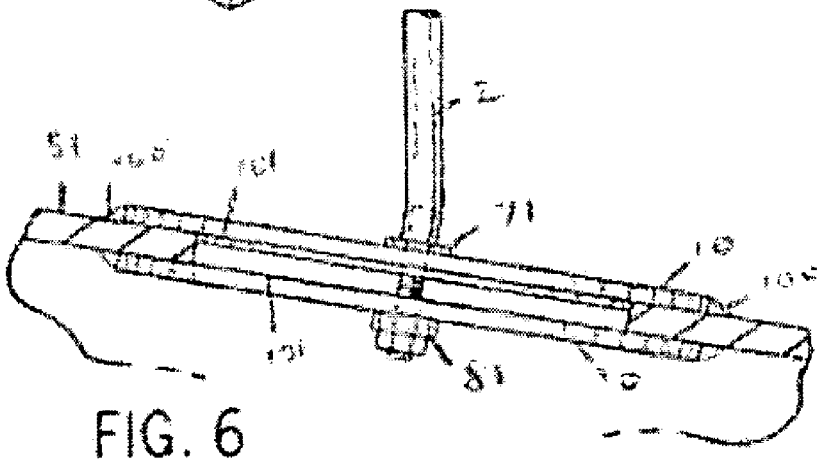
FIG. 6 illustrates a side plan view of the portable horseshoe game wherein the rod is bent.

In an embodiment, the bottom side 12 of the first plate 10 and the bottom side 22 of the second plate 20 may be magnetic 101 (FIG. 6). More specifically, the bottom side 12 of the first plate 10 may have a magnetic charge opposite to a magnetic charge on the bottom side 22 of the second plate 20 such that the two bottom surfaces attract. Having the bottom sides of the plates attract may further help to secure the rod 2 in position within the opening 52 of the target surface 51. In an embodiment, the bottoms of the first plate 10 and the bottom of the second plate 20 may have a sticky substance which helps secure the plates to the target surface 51. In another embodiment, a seal 125 (as illustrated in FIG. 3) may be present around the first plate 10 and the second plate 20 such that a suction is created by the insertion of the first plate 10 having a seal 125 and the second plate 20 having a seal 125 around the opening 52 of the bags game 50. The seal 125 may help secure the portable horseshoe game 1 onto the target surface 51 of the bags game 50.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A portable horseshoe game comprising:

a generally cylindrical rod having a first end, a second end, a width and a length;

a first plate having a top side and a bottom side and an opening wherein the opening of the first plate is slightly larger than the width of the rod;

a second plate having a top side and a bottom side and an opening wherein the opening of the second plate is slightly larger than the width of the rod;

a securing device for securing the first plate to the rod and a securing device for securing the second plate to the rod wherein the rod is inserted through the first plate and the second late;

wherein the first plate and the second plate are separated by and secured on a target surface of a bags toss game; and wherein the rod is bent at an angle substantially equal to an angle of the target surface of the bags toss game with respect to the ground.

2. A portable horseshoe game comprising:

a generally cylindrical rod having a first end, a second end, a width and a length;

a first plate having a top side and a bottom side and an opening wherein the opening of the first plate is slightly larger than the width of the rod;

a second plate having a top side and a bottom side and an opening wherein the opening of the second plate is slightly larger than the width of the rod;

a securing device for securing the first plate to the rod and a securing device for securing the second plate to the rod wherein the rod is inserted through the first plate and the second late; wherein the first plate and the second plate are separated by and secured on a target surface of a bags toss game; and a gasket creating a seal between the first plate and the target surface of a bags toss game and a second gasket creating a second seal between the second late and the target surface of a bags toss game and wherein the first plate and the second plate are at least partly secured to the target surface of the bags toss game by suction forces.

3. A portable horseshoe game comprising:

a generally cylindrical rod having a first end, a second end, a width and a length;

a first plate having a top side and a bottom side and an opening wherein the opening of the first plate is slightly larger than the width of the rod;

a second plate having a top side and a bottom side and an opening wherein the opening of the second plate is slightly larger than the width of the rod;

a securing device for securing the first plate to the rod and a securing device for securing the second plate to the rod wherein the rod is inserted through the first plate and the second late; wherein the first plate and the second plate are separated by and secured on a target surface of a bags toss game; and a tapered edge on the first plate wherein the tapered edge allows an object to slide easily from the target surface of a bags toss game onto the top of the first plate.

* * * * *